United States Patent [19]

Muramatsu et al.

[11] Patent Number: 4,864,460

[45] Date of Patent: Sep. 5, 1989

[54] ELECTRICALLY CONDUCTING DEVICE FOR AN ELECTRODE ROLLER

[75] Inventors: Kuniyoshi Muramatsu; Masashi Higuchi; Yoshinori Ogi; Hisao Kaji; Katsuhiko Sano; Hirofumi Takagi; Satoru Nagai, all of Fujinomiya, Japan

[73] Assignee: Fuji Photo Film Co., Ltd., Kanagawa, Japan

[21] Appl. No.: 209,810

[22] Filed: Jun. 22, 1988

[30] Foreign Application Priority Data

Jun. 25, 1987 [JP] Japan ..... 62-97705[U]

[51] Int. Cl.[4] ..... H05F 3/02

[52] U.S. Cl. ..... 361/220; 439/92; 439/95

[58] Field of Search ..... 361/212, 214, 220–222; 439/92, 95

[56] References Cited

U.S. PATENT DOCUMENTS 2,196,388 4/1940 Ewald ..... 361/212 X
3,531,314 9/1970 Kerr et al. ..... 430/505
4,801,270 1/1989 Scarlata ..... 439/92 X

FOREIGN PATENT DOCUMENTS

WO87/00389 1/1987 PCT Int'l Appl. ..... 361/220

*Primary Examiner*—L. T. Hix
*Assistant Examiner*—Brian W. Brown
*Attorney, Agent, or Firm*—Sughrue, Mion, Zinn, Macpeak & Seas

[57] ABSTRACT

An electrically conducting device for use with an electrode roller suitable for causing the electrode roller, which removes electrostatic charges developed on the surface of a web or the like when the web is brought into sliding contact the roller or controls the charges into uniform ones, to conduct with respect to the ground or a power source. The conducting device includes an electrically conducting ring which is slidably fitted over the rotary shaft of the electrode roller. The conducting ring is prevented against rotation by rotation preventive means and is electrically connected through an electrically conducting member to the ground or power source.

6 Claims, 2 Drawing Sheets

ELECTRICALLY CONDUCTING DEVICE FOR AN ELECTRODE ROLLER

BACKGROUND OF THE INVENTION

1. FIELD OF THE INVENTION

The present invention relates to an electrically conducting device for use with an electrode roller and, in particular, to an electrically conducting device for use with an electrode roller which is used to apply a corona discharge for activation of the surface of a web (paper, plastic sheet or the like) employed as a photographic film base or the like, or to make uniform the electrostatic charge that is generated on the surface of the web due to the corona activation or the like.

2. DESCRIPTION OF THE RELATED ART

Some of the webs for use in photography have a surface which can be hydrophobic. For example, the surface of a photographic paper can be coated with a polymer film and a polymer, so that the paper surface can be additionally provided with a water proof property and the like, that is, it becomes hydrophobic. However, in order that a photographic emulsion, especially, a gelatino-silver halide emulsion or the like can be adhered to the photographic paper, the paper surface must by hydrophilic. For this reason, in the case of the photographic paper with the polymer coated thereto, a strong corona discharge is applied to the surface of the paper so that it is activated, that is, the paper surface becomes hydrophilic. Also, when such corona discharge is effected, then there is developed an irregular electrostatic charge on the surface of the coated polymer. The irregular static charge makes it impossible for the emulsion to be coated uniformly. In view of this, the irregular static charge must be removed from the surface of the photographic paper or must be controlled into a uniform one before the paper surface is coated with the emulsion.

When the corona discharge is applied to the above-mentioned hydrophobic photographic paper surface or the like, or when the irregular static charge is controlled into the uniform static charge, an electrode roller is used.

In FIG. 5, there is shown a flow diagram of a corona discharge treatment or a static charge uniforming treatment on the surface of a photographic paper by use of an electrode roller, which is disclosed in U.S. Pat. No. 3,531,314 patented on Sept. 29, 1970. As shown in FIG. 5, a web 50, which is treated by a corona discharge or on which a static charge is made uniform is supplied from a roller 52. The web 50 is brought into sliding contact with an electrode roller 54, rollers 56, 58, an electrode roller 60 and a delivery roller 62 in this order through which the web 50 is transported and treated at the high speed. The electrode roller 54 has a main body 55 which is composed of an electrically conducting material, and also has a rotary shaft 64 which is grounded. Above the electrode roller 54 there is arranged a discharge electrode 68 which is connected to a power source 66, and a corona discharge is applied between the discharge electrode 68 and the electrode roller 54.

Another electrode roller 60, which is arranged downstream in FIG. 5, has a main body 61 which is also composed of an electrically conducting material and also has a rotary shaft 69 which is connected to another power source 71 and to which a voltage of 500 to 50,000 volts is applied. And, below the electrode roller 60 there is disposed a knife-shaped electrode 73 which is grounded. In this structure, a given voltage is applied across the electrode roller 60 and the knife-shaped electrode 73.

In the above-mentioned construction, the web 50 is brought into sliding contact with the electrode rollers 54 and 60 at a speed of 15 to 180 m/min. (50 to 600 fpm) or higher before it is fed out. When the web 50 is brought into sliding contact with the electrode roller 54, the surface of web 50 is activated by a corona discharge so that it becomes hydrophilic. Also, when the web 50 is brought into sliding contact with the electrode roller 60, the irregularities of the static charges on the web surface are controlled to be uniform. By means of the above-mentioned corona activation and static charge uniforming treatments, the web can be coated with a photographic emulsion with good adherence in the following stage.

By the way, in a conventional electrode roller, when the roller is made to conduct with respect to a grounding surface or a power source, an electric brush is brought into sliding contact with the rotary shaft thereof and is also connected with a power terminal or the grounding surface. FIGS. 6(*a*) and (*b*) are respectively a side view and a section view to illustrate the connection portions between the electrode roller and brush in the prior art. The electrode roller has a rotary shaft 70 over which an electrically conductive ring member 72 is fitted and secured, and a pair of electric brushes 74, 74 are in sliding contact with the outer peripheral surface of the ring member 72. The pair of electric brushes 74, 74 are mounted to the leading ends of a pair of arms 78, 78 of a holding device 76, respectively. Each of the arms 78, 78 is rotatably mounted through a pin 89 to the main body of the holding device 76. The main body of the holding device 76 is provided with a metal fitting member 82 and there are provided springs 84, 84 respectively between the metal fitting member 82 and the middle portions of the arms 78, 78. The springs 84, 84 respectively energize the pair of arms 78, 78 in the directions of shown arrows, and the electric brushes 74, 74 are brought into sliding contact with the outer peripheral surface of the ring member 72. The main body of the holding device 76 and the arms 78 are respectively formed of an electrically conductive material, and the main body of the holding device 76 is connected to a terminal of a power supply unit or to the ground, although not shown. Thanks to this, while rotating, the electrode roller is caused to conduct with respect to the power supply unit or the ground through the rotary shaft 70, ring member 72 and electric brushes 74, so that the irregular static charge developed on the surface of the web or the like in sliding contact with the above-mentioned electrode roller can be controlled into a uniform static charge.

However, in the above-mentioned conventional electrically conducting device for use with the electrode roller, since the electric brush 74 is brought into sliding contact with the ring member 72 in such a manner that it is energized by the spring 84, if the electrode roller is rotated at high speeds, then the electric brush 74 is caused to wear heavily and generate powdered dust to thereby pollute its environment, so that a reliability on the conduction of the roller with respect to the outer peripheral surface of the ring member 72 is unfavorably reduced.

SUMMARY OF THE INVENTION

The present invention aims at eliminating the drawbacks found in the above-mentioned prior art device Accordingly, it is an object of the invention to provide an electrically conducting device for use with an electrode roller which is highly resistant to wear and also which is highly reliable in conduction even when the electrode roller is rotated at the high speed.

In attaining the above object, according to the invention, there is provided an electrically conducting device for use with an electrode roller for causing the electrode roller to conduct with respect to the ground or a power source, the electrode roller capable of removing an electrostatic charge developed on the surface of a web or the like when the web is in sliding contact with the roller or controlling the electrostatic charge into a uniform one, the electrically conducting device comprising: an electrically conducting ring having an internal peripheral surface in the form of a sliding surface and fitted over a rotary shaft of the electrode roller; rotation preventive means for preventing the rotation of the electrically conducting ring; and, an electrically conducting member for electrically connecting the electrically conducting ring with the ground or the power source.

According to the electrically conducting device for use with an electrode roller constructed in accordance with the present invention, the electrically conducting ring is fitted over the rotary shaft of the electrode roller and is slid in contact therewith and also the conducting ring is connected with the ground or the power source, so that the conducting ring in sliding contact with the electrode roller rotary shaft can provide a high reliability in conduction with respect to the electrode roller even the electrode roller is rotated at the high speed, eliminating the possibility that the conducting ring may be worn to produce powdered dust.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the preferred embodiment of an electrically conducting device for use with an electrode roller according to the present invention with reference to the accompanying drawings.

Figure 1:
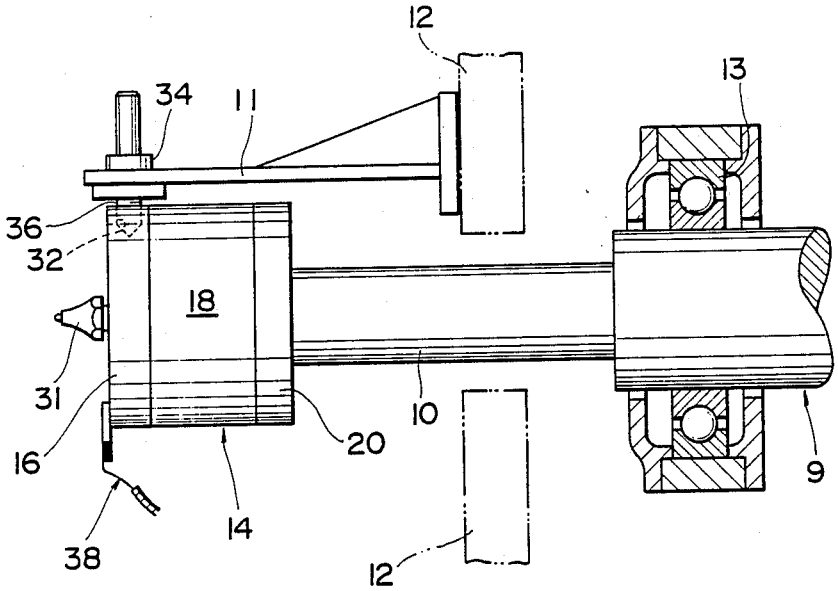
FIG. 1 is a side view of an electrically conducting device for use with an electrode roller according to the invention.

Referring first to FIG. 1, there is shown a side view of an electrode roller according to the present invention. As shown in FIG. 1, there is arranged an electrically conducting device 14 in the end portion of a shaft 10 which is supported by a rotary shaft bearing 13 of the electrode roller 9.

Figure 2:
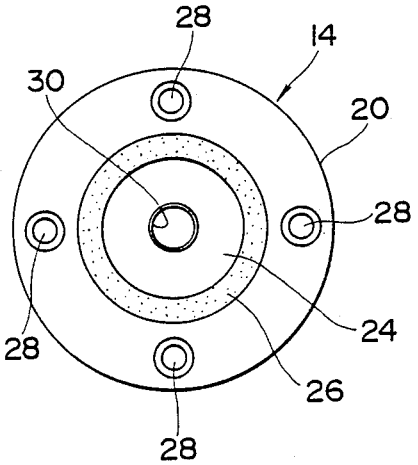
FIG. 2 is a front view of an electrically conducting device for use with an electrode roller according to the invention.
Figure 3:
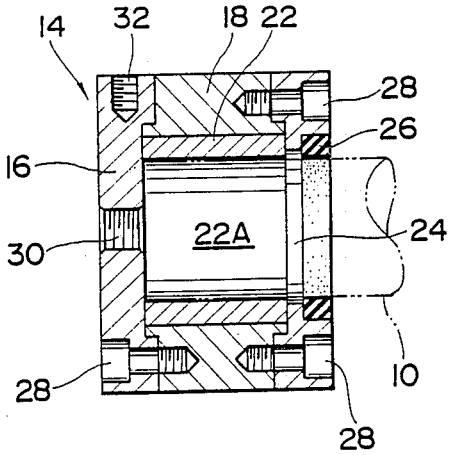
FIG. 3 is a section view of an electrically conducting device for use with an electrode roller according to the invention.

As shown in FIG. 2 and 3, the electrically conducting device 14 is composed of an external cover 16, a ring cover 18, an internal cover 20 and an oilless metal ring 22 disposed within the ring cover 18. The internal cover 20 is formed with a hole 24 for insertion of the rotary shaft 10 and a seal member 26 is mounted to the insertion hole 24. Also, the internal cover 20 is formed with a plurality of bolt fitting holes 28, 28 ... and thus the internal cover 20 can be mounted to the ring cover 18 by means of threaded engagement of bolts with the fitting holes 28.

The ring cover 18 is formed of an electrically conducting material and the metal ring 22 is fitted into the internal peripheral surface of the cover 18. The metal ring 22 may be composed of a highly conductive material such as a steel material, a copper (Cu) alloy, a silver (Ag) alloy or similar material and the internal peripheral surface 22A of the metal ring 22 is formed as a sliding surface which can be brought into sliding contact with the external peripheral surface of the rotary shaft 10 and is allowed to conduct.

The external cover 16 is made of an electrically conducting material. The external cover 16 is formed in the central portion thereof with a grease nipple fitting screw 30 and, as shown in FIG. 1, a grease nipple 31 is threadedly engaged with the fitting screw 30, through which grease nipple 31 grease can be poured. Also, the external cover 16 is formed with a plurality of bolt fitting holes 28, 28 ... and the external cover 16 can be mounted to the ring cover 18 by means of threaded engagement between the fitting holes and bolts. Further, in the external peripheral surface of the external cover 16 there is formed a rotation preventive hole 32 and, as shown in FIG. 1, an engagement pin 36 of a stop device 34 is inserted into the rotation preventive hole 32.

The stop device 34 is mounted through an arm 11 to a machine frame 12. The electrically conducting device 14 is held by the stop device 34 in such a manner that it cannot be rotated together with the shaft 10. It should be noted here that the stop d 34 is insulated from the arm 11. To the external cover 16 there is connected an electric wire 38 which is in turn connected to a terminal of a power source or a grounding terminal (either of which is not shown).

According to the electrically conducting device for use with an electrode roller constructed in the above-mentioned manner, when the electrode roller is rotated, the rotary shaft 10 can be brought into sliding contact with the internal surface 22A formed as a sliding surface in the oilless metal ring 22 and thus the shaft 10 is allowed to conduct accurately.

Figure 4:
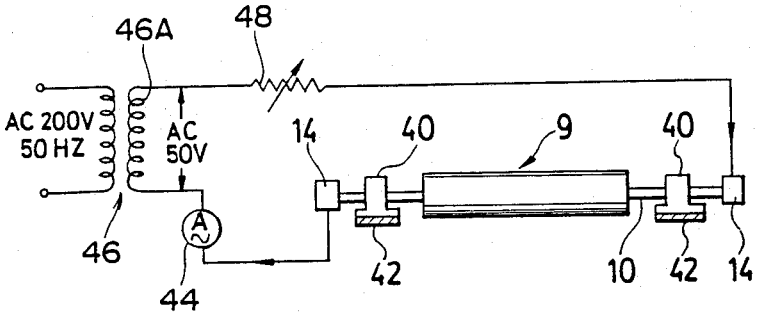
FIG. 4 is an explanatory view to explain how to examine electrical conduction using an electrode roller according to the invention.
Figure 5:
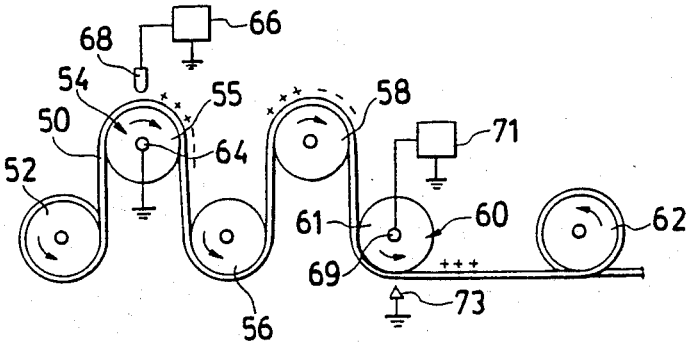
FIG. 5 is a flow sheet to illustrate how to apply a corona discharge onto the surface of a web and how to control an electrostatic charge developed on the web surface into a uniform one, using an electrode roller; and, FIGS. 6(*a*) and (*b*) are respectively side and section views of the main portions of a conventional electrode roller.
Figure 6A:
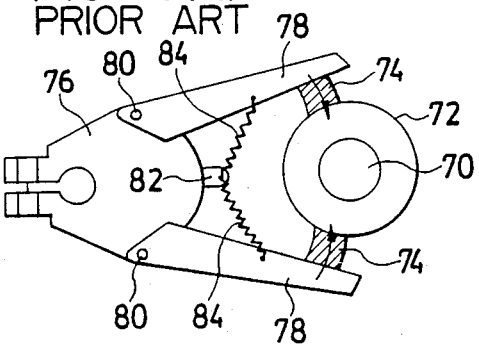
FIG. 6(a) PRIOR ART
Figure 6B:
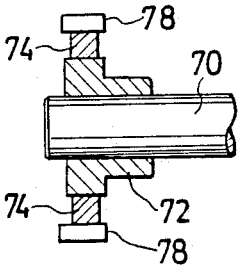
FIG. 6(b) PRIOR ART

Referring now to FIG. 4, there is shown an explanatory view of a device for checking the conductive property of the electrically conducting device for use with the electrode roller according to the present invention. The electrode roller 9 is fixed by means of bearings 40, 40 and insulators 42, 42 and the electrically conducting devices 14 are respectively mounted to the two ends of the rotary shaft 10. The two conducting device 14, 14 respectively connected to the shaft ends are connected through an ammeter 44, a secondary coil 46A of a transformer 46 and a variable resistance 48, and to the thus produced circuit is supplied an AC voltage which is reduced from 200V down to 50V by the above-mentioned transformer 46.

And, as the test conditions, the value of a variable resistance 48 is controlled so that a current is 45A and the number of rotations of the rotary roller 9 is set to vary in the range of 0 to 300 rpm. Under the above-mentioned test conditions, the test device was operated continuously for a period of 480 hours.

As a result of the above test, it was found that the current flows always constantly and stably. This shows that the metal ring 22 having a sliding surface and the rotary shaft 10 are brought into sliding contact with each other, causing them to conduct stably.

Due to the fact that the metal ring 22 is in sliding contact but is not pressed by a spring or the like, wear is reduced and thus generation of abrasive dusts is reduced. In addition, since the metal ring 22 is stored within the covers 16, 18, 20, there is eliminated the possibility that the abrasive dusts produced from the sliding contact surface of the metal ring 22 may pollute the web or the like.

In the above-mentioned embodiment, when prevention of dusts is not necessary, the covers may be removed and only the metal ring 22 is directly brought into sliding contact with the rotary shaft 10 so that the metal ring 22 can be connected to the power source or an attachment.

As has been described heretofore, in the electrically conducting device for use with an electrode roller according to the invention, since the metal ring is fitted over with the rotary shaft of the electrode roller and is slid in contact therewith, the metal ring is highly resistant to wear and is highly reliable in conduction, so that the metal ring is able to perform its function as an electrically conducting device for an electrode roller even when the electrode roller is rotated at the high speed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claim is:

1. An electrically conducting device for use with an electrode roller for causing the electrode roller to conduct with respect to the ground or a power source, the electrode roller capable of removing an electrostatic charge developed on the surface of a web or the like when the web is in sliding contact with the roller or controlling the electric charge into a uniform one, said electrically conducting device comprising:

an electrically conducting ring having an internal peripheral surface in the form of a sliding surface and adapted to be fitted over a rotary shaft of said electrode roller, wherein said electrically conducting ring is interposed between an external cover, adapted to face the end face of said rotary shaft and an internal cover adapted to be fitted over said rotary shaft and having a seal member to attendantly prevent the contamination of the web by abrasive dusts;

rotation preventive means for preventing the rotation of said electrically conducting ring; and an electrically conducting member for electrically connecting said electrically conducting ring with said ground or said power source.

2. An electrically conducting device for use with an electrode roller as set forth in claim 1, wherein said electrically conducting ring is formed of an oilless metal.

3. An electrically conducting device for use with an electrode roller as set forth in claim 1 or 2, wherein said electrically conducting ring is fitted into an internal peripheral surface of a ring cover.

4. An electrically conducting device for use with an electrode roller as set forth in claim 1, wherein said external cover is provided with a grease nipple for pouring of grease.

5. An electrically conducting device for use with an electrode roller as set forth in claim 1, wherein said rotation preventive means includes a stop device having a pin which engages a hole formed in an external peripheral surface of said external cover.

6. An electrically conducting device for use with an electrode roller as set forth in claim 1, wherein said electrically conducting member includes an electric wire connected to said external cover at one end and connected to said ground or said power source at the other end.

* * * * *